US007036285B2

(12) United States Patent
Hunter, Jr.

(10) Patent No.: US 7,036,285 B2
(45) **Date of Patent: *May 2, 2006**

(54) SEAMLESS FOAM PANEL ROOFING SYSTEM

(76) Inventor: John P. Hunter, Jr., 344 Country Rd., 39A, Southampton, NY (US) 11968

( * ) Notice: Subject to any disclaimer, the term of this patent is extended or adjusted under 35 U.S.C. 154(b) by 0 days.

This patent is subject to a terminal disclaimer.

(21) Appl. No.: 10/601,046

(22) Filed: Jun. 21, 2003

(65) Prior Publication Data

US 2004/0074181 A1 Apr. 22, 2004

Related U.S. Application Data

(63) Continuation of application No. 10/022,612, filed on Dec. 18, 2001, now Pat. No. 6,581,348.
(60) Provisional application No. 60/298,517, filed on Jun. 15, 2001.

(51) Int. Cl.
*E04B 7/00* (2006.01)

(52) U.S. Cl. ..... 52/746.11; 52/408; 52/412; 52/309.4; 52/309.8; 52/741.4; 428/319.3; 442/370

(58) Field of Classification Search ..... 442/370, 442/374; 428/318.4, 319.3; 52/408, 409, 52/412, 582.1, 586.1, 585.1, 589.1, 591.1, 52/591.4, 592.1, 309.4, 309.8, 746.11, 741.4
See application file for complete search history.

(56) References Cited

U.S. PATENT DOCUMENTS

| | | | | | |
|---|---|---|---|---|---|
| 2,215,811 | A | * | 9/1940 | Figge | 52/479 |
| 3,045,293 | A | * | 7/1962 | Potchen | 52/309.8 |
| 4,274,238 | A | * | 6/1981 | O'Riordain | 52/408 |
| 4,320,605 | A | * | 3/1982 | Carlson et al. | 52/94 |
| 4,351,138 | A | * | 9/1982 | McMillan et al. | 52/309.4 |
| 4,443,993 | A | * | 4/1984 | Fujiki et al. | 52/746.11 |
| 4,651,494 | A | * | 3/1987 | Van Wagoner | 52/592.1 |
| 4,719,723 | A | * | 1/1988 | Van Wagoner | 52/15 |
| 4,764,420 | A | * | 8/1988 | Gluck et al. | 428/317.7 |
| 5,067,298 | A | * | 11/1991 | Petersen | 52/742.14 |
| 5,079,885 | A | * | 1/1992 | Dettbarn | 52/282.1 |
| 5,144,782 | A | * | 9/1992 | Paquette et al. | 52/408 |
| 5,317,852 | A | * | 6/1994 | Howland | 52/408 |
| 6,358,599 | B1 | * | 3/2002 | Deibel et al. | 428/308.4 |
| 6,368,991 | B1 | * | 4/2002 | Horner et al. | 442/374 |
| 6,427,404 | B1 | * | 8/2002 | Hageman | 52/309.4 |
| 6,586,080 | B1 | * | 7/2003 | Heifetz | 428/198 |
| 6,698,149 | B1 | * | 3/2004 | Ruchgy | 52/309.4 |

* cited by examiner

*Primary Examiner*—Brian E. Glessner
(74) *Attorney, Agent, or Firm*—Alfred M. Walker

(57) ABSTRACT

A crush resistant seamless roofing system is formed by a layer of adjacent panels having loose joints filled by expanding rising foam adhesive, which is trimmed to remove excess foam adhesive above a top plane of the roofing system. The roofing system thus formed is covered by a fabric layer and a coating.

12 Claims, 4 Drawing Sheets

SEAMLESS FOAM PANEL ROOFING SYSTEM

This application is a continuation of application Ser. No. 10/022,612, filed Dec. 18, 2001, now U.S. Pat. No. 6,581, 348, which claims the benefit of Provisional application Ser. No. 60/298,517, filed Jun. 15, 2001.

FIELD OF THE INVENTION

The present invention relates to roofing systems.

BACKGROUND OF THE INVENTION

Rigid foam panels are currently available for use as an insulating underlayment in roof construction. Typically these are 4' by 8' (1.22 m by 2.44 m) panels 1.5" (3.8 cm) thick made of a 1.6 pound per cubic foot polyurethane foam with a tar paper top layer. Such a material is not crush resistant enough to be used as a roof surface material and can also be easily punctured.

OBJECTS OF THE INVENTION

It is therefore an object of the present invention to provide a sturdy, weatherproof, seamless roofing system that uses rigid foam boards or panels to create a seamless waterproof roof.

SUMMARY OF THE INVENTION

The roofing panels of this invention differ from the prior art underlayment product in several respects. The panels of this invention are:

a) made of a denser polyurethane foam (approximately 3 pounds per cubic foot) and, b) include an integral top layer of non-woven 250 gram polyester fabric that is saturated by the foam during manufacture by the laminator in a controlled factory environment.

The higher density affords more crush resistance, while the well bonded top layer resists punctures and provides a better adhesion surface for elastomeric top coats.

The roofing panels are bonded to roof substrate with low rise foam polyurethane adhesive which seeps through loose tongue-in-groove joints to form a blob at the top, which is shaved off and covered with a fabric top layer.

After the adhesive cures, a very secure bond between the panels results.

The low rise foam adhesive is a two-part mixture that has distinct phases after mixing. By varying the formulations of the two parts, the "cream time" (i.e.—to achieve the consistency of shaving cream) as well as the "tack free" time can be controlled.

The panels are placed on the foam just after cream consistency and well before tack-free time so that the foam rises through the joints. After the adhesive cures to a solid consistency, the blobs are removed from all of the joints. This is typically accomplished by grinding using a disk pad grinder.

The roof is finished by applying a layer of waterproof elastomeric coating which covers the entire surface creating a monolithic structure.

BRIEF DESCRIPTION OF THE DRAWINGS

The present invention can best be understand in connection with the accompanying drawings, in which.

DETAILED DESCRIPTION OF THE INVENTION

The roofing system of this invention uses rigid foam boards or panels to create a seamless waterproof roof. It can be used over a number of different substrates including metal decking, tar and gravel, or polyurethane foam in new construction as well as re-roofing applications.

Rigid foam panels are currently available for use as insulating underlayment in roof construction. Typically these are 4' by 8' (1.22 m by 2.44 m) panels 1.5" (3.8 cm) thick made of a 1.6 pound per cubic foot polyurethane foam with a tar paper top layer. Such a material is not crush resistant enough to be used as a roof surface material and can also be easily punctured.

The roofing panels of this invention differ from this underlayment product in several respects. Although panel size as well as material are similar, the panels of this invention are made of a denser polyurethane foam (approximately 3 pounds per cubic foot) and include an integral top layer of non-woven 250 gram polyester fabric that is saturated by the foam during manufacture by the laminator in a controlled factory environment. The higher density affords more crush resistance, while the well bonded top layer resists punctures and provides a better adhesion surface for elastomeric top coats.

Figure 1:
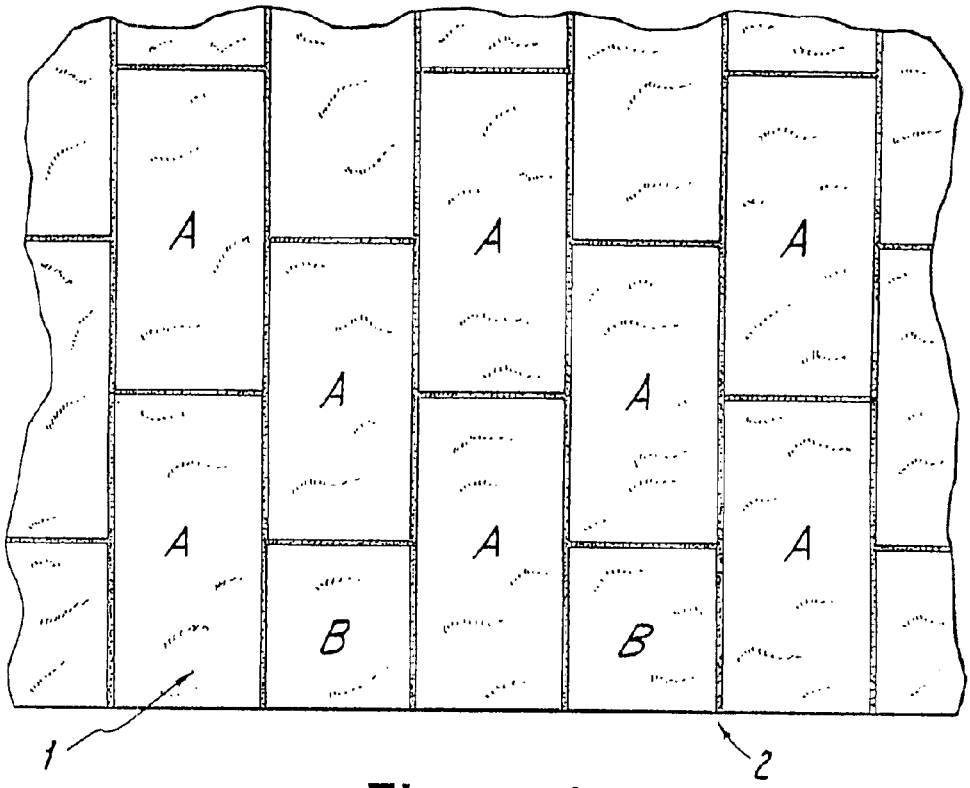
FIG. 1 is a top plan view of a roof section; showing outlines of roofing panels of this invention.

FIG. 1 is a top view of a roof 1 section showing the outline of the individual roof panels. The panel seams are staggered by using alternate whole panels A as well as half panels B at the roof edge 2. This is done to prevent any tendency for propagation of inadvertent seam separations.

Figure 2:
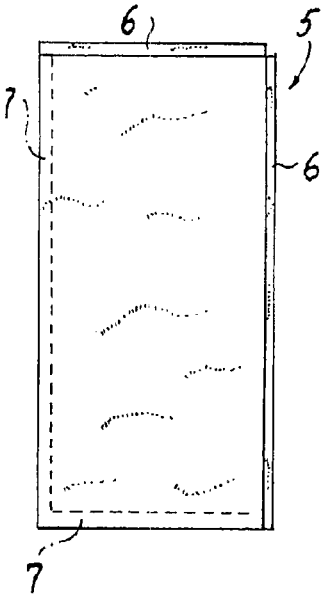
FIG. 2 is a top plan view of an embodiment for a tongue-in-groove roofing panel of this ivention.

FIG. 2 shows a top view of a tongue-in groove panel 5 tongue edges 6 and groove edges 7.

Figure 3:
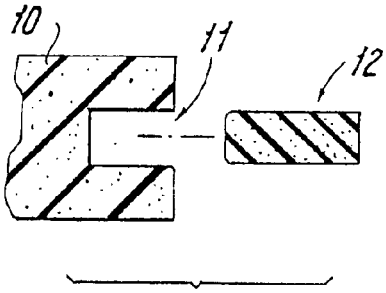
FIG. 3 is an edge crossection detail view of further embodiment for an all-groove panel of this invention with an insertable tongue board.

Since a protruding tongue of polyurethane foam could be damaged in transit, an alternate embodiment of a tongue-in groove construction is shown in FIG. 3. In this all-groove construction, each polyurethane panel 10 has grooves 11 cut in all four edges. A length of polyurethane plank 12 is then inserted in groove 11 on two edges at the work site. Plank 12 is dimensioned as a press fit in groove 11 and protrudes from the edge to form the tongue after insertion. Planks 12 would be shipped separately in protective packaging to the work site.

Figure 4:
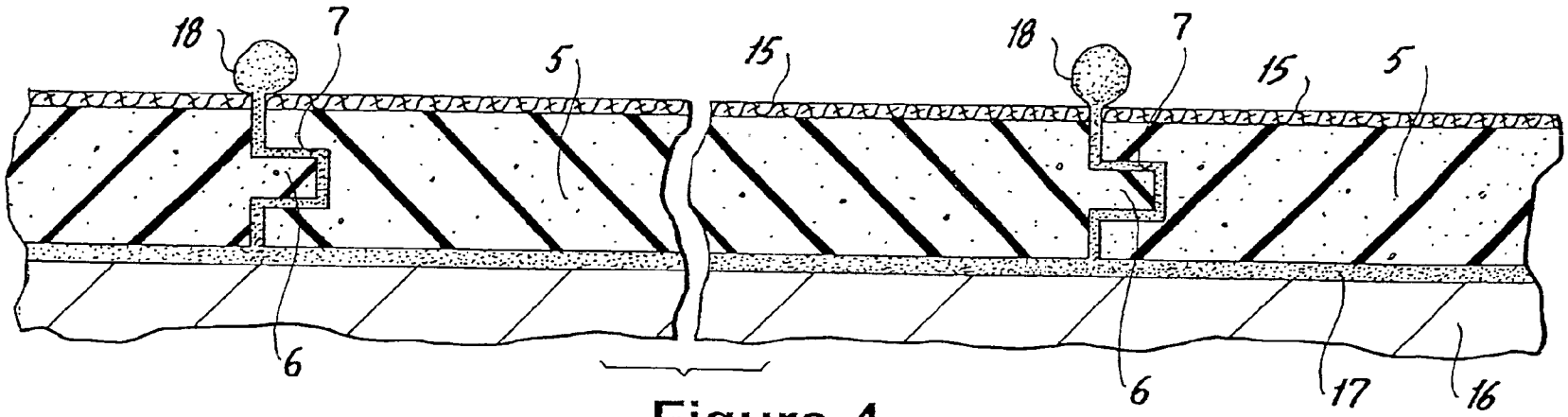
FIG. 4 is an edge crossection view of yet another embodiment for tongue-in-groove roofing panels of this invention, shown adhesively bonded to a roof substrate.

FIG. 4 is an edge crossection view of roofing panels 5 bonded to roof substrate 16 with low rise foam polyurethane adhesive 17 which seeps through loose tongue-in-groove joints to form a blob 18 at the top. Factory bonded fabric 15 is a top layer. Typically, the groove 7 is ⅞" (22 mm) wide while the tongue is ¾" (19 mm) wide; this affords enough space for the adhesive foam to rise through while affording close line-up of the top surfaces of adjacent boards 5. After adhesive 17 cures, a very secure bond between panels 5 results.

Figure 5:
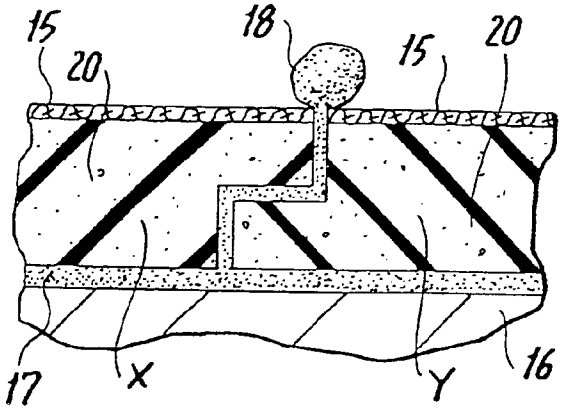
FIG. 5 is an edge crossection detail view of a still further alternate embodiment of this invention, shown with a ship-lap joint configuration.
Figure 7:
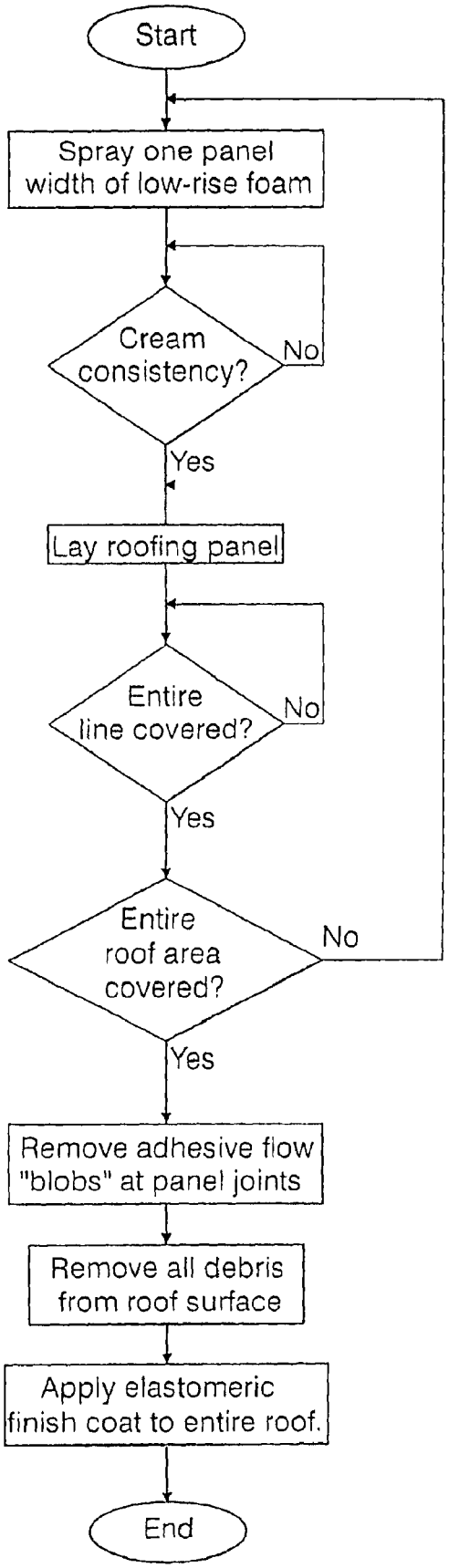
FIG. 7 is a high level flow chart of the roofing system method of this invention; and, FIG. 8 is a roof edge detail view in crossection, illustrating flashing and interfacing to the roofing system of this invention.

FIG. 5 is a detail of an alternative panel joint. Here panels 20 have a ship-lap edge which is also dimensioned so as to permit rising foam adhesive to flow through the joint. For ship-lap panels 20, the order in which they are laid into the foam is important.

As shown in FIG. 5, panel X should be laid down before panel Y so that there would not be a tendency to lift panel Y during the foam rising phase.

Foam adhesive is a two-part mixture that has distinct phases after mixing. By varying the formulations of the two parts, the "cream time" (i.e.—to achieve the consistency of shaving cream) as well as the "tack free" time can be controlled. For this invention, a cream time of about 1 minute and a tack-free time of about 4 minutes is ideal. The panels are placed on the foam just after cream consistency and well before tack-free time so that the foam rises through the joints.

After the adhesive cures to a solid consistency, the blobs 18 are removed from all of the joints. This is typically accomplished by grinding using a cutter, such as a knife or disk pad grinder. At this stage, the joint is flush with the fabric top surface of the adjacent panels.

The roof is finished by applying a layer of waterproof elastomeric coating which covers the entire surface creating a monolithic structure.

Figure 6:
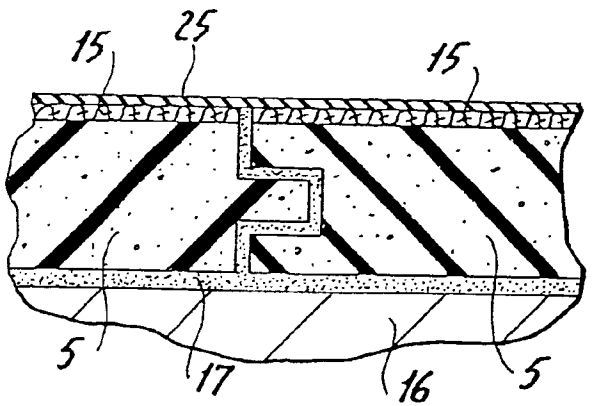
FIG. 6 is an edge crossection detail view showing a panel joint of this invention in a finished roof section.

FIG. 6 is a detail of a finished joint between two panels 5 after the blob 18 has been removed and elastomeric coating 25 has been applied. Coating 25 can be an acrylic, urethane or silicone material. It can be sprayed or brushed on.

Flow chart 7 is a concise description of the overall installation process. Two people are generally involved as a team. One worker sprays a panel-width line of low rise polyurethane adhesive, while the second worker follows (after the mix is of cream consistency) and lay down panels. As per FIG. 1, the first panel at an edge is either a full or half panel to create the staggered seam pattern. Only after the entire roof (or large section) is paneled, are the seep-through joint blobs removed. All debris must be removed carefully before a final seal coat is applied.

Penetrations and wall flashings are first sealed with spray foam prior to sealing.

Figure 8:
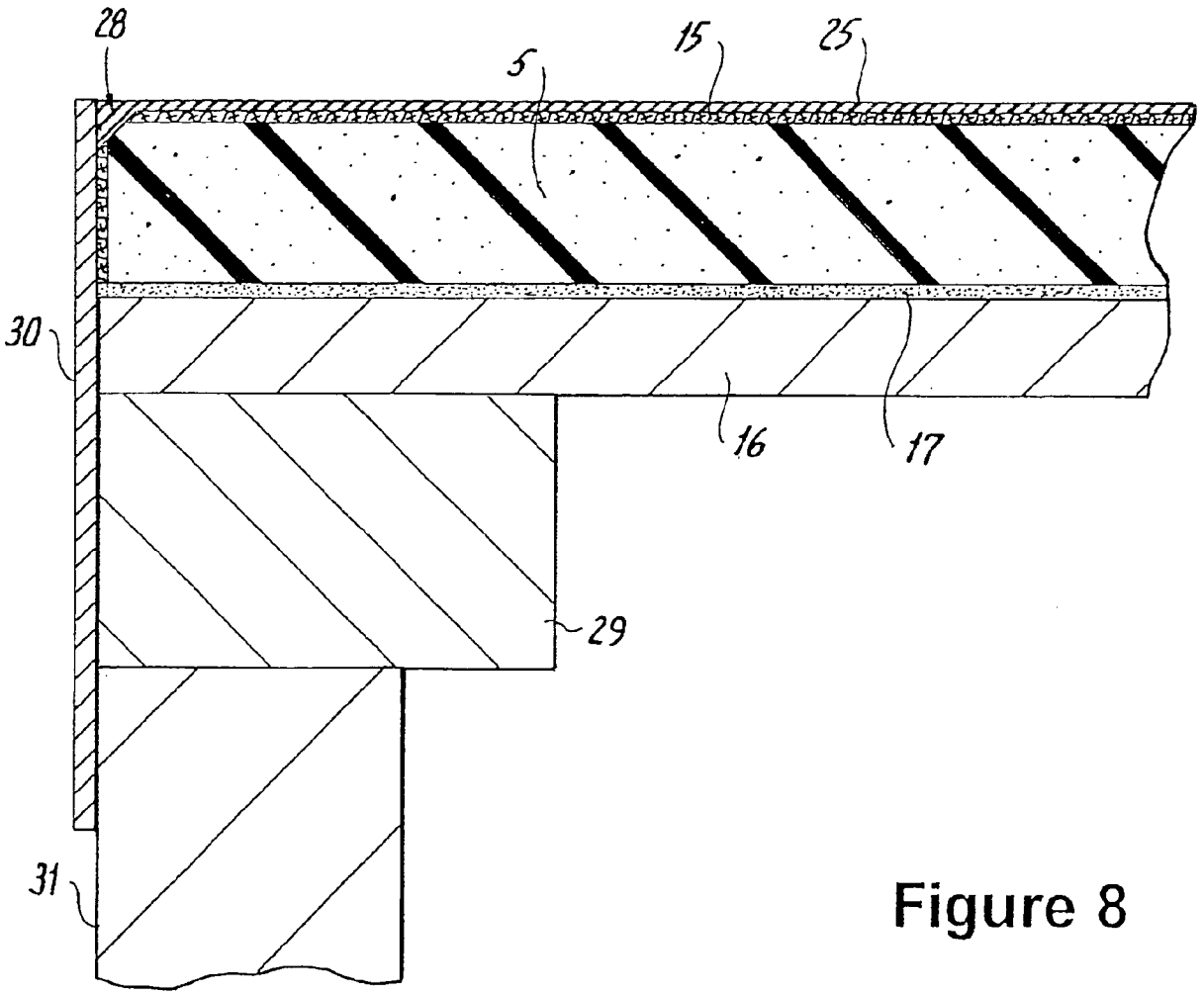

FIG. 8 is a detail at a roof edge showing an end panel 5 interfacing with aluminum edging 30 which bridges wall 31, beam 29 and foam panel 5. A V-groove 28 is cut from the corner of panel 5 at the juncture of edging 30 to permit an aluminum surface to be bonded and sealed to the fabric 15 top layer by waterproof coating 25.

It is further noted that other modifications may be made to the present invention, within the scope of the invention, as noted in the appended Claims.

I claim:

1. A method of producing a seamless roofing system comprising the steps of:

providing a plurality of hardened foam roofing panels, applying layer of a rising foam adhesive to a predetermined surface of a roof to be covered, placing a first hardened foam roofing panel of said plurality of hardened foam roofing panel upon said rising foam adhesive upon said roof to be covered;

each said hardened foam roofing panel being formed of polyurethane foam wherein each said hardened foam roofing panel has a density of about 2.5 to 3.16 cubic pounds per foot and said hardened foam roofing panel has a top surface, a bottom surface, and at least one first indented periphery;

said top surface having an integral layer of fabric bonded to said hardened foam roofing panel;

mating said at least one first indented periphery of said first hardened foam roofing panel to a further hardened foam roofing panel upon said layer of rising foam adhesive applied to said predetermined surface of said roof, said further hardened foam roofing panel having at least one further indented periphery, said at least one further hardened foam roofing panel having a density substantially equal to said density of said first hardened foam roofing panel, said at least one first indented periphery of said first hardened foam roofing panel being larger than said at least one second indented periphery of said second hardened foam roofing panel, thereby preventing a tight fit between said at least one first indented periphery of said first hardened foam roofing panel and said at least one second indented periphery of said second hardened foam roofing panel, fitting said at least one first indented periphery and said at least one second indented periphery loosely together with a gap provided between said first hardened foam roofing panel and said at least one second hardened foam roofing panel, and, allowing said rising foam adhesive to rise within said gap therebetween.

2. A method of producing a seamless roofing system according to claim 1, wherein said at least one first indented periphery and said at least one further indented periphery are tongue and groove, respectively.

3. A method of producing a seamless roofing system according to claim 2, wherein said groove is about 22 mm wide and said tongue is about 19 mm wide.

4. A method of producing a seamless roofing system according to claim 2, wherein said at least one first indented periphery and said at least one further indented periphery together form a respective ship and lap joint, respectively.

5. A method of producing a seamless roofing system according to claim 2, wherein said at least one first indented periphery anti said at least one further indented periphery each have a first and a second groove, respectively; and a tongue slideably mounted within said first and said second grooves.

6. The method of producing a seamless roofing system as in claim 1 wherein said fabric is a non-woven polyester fabric.

7. A method of producing a seamless roofing system comprising the steps of:

providing a plurality of hardened foam roofing panels, applying layer of a rising foam adhesive to a predetermined surface of a roof to be covered, placing a first hardened foam roofing panel of said plurality of hardened foam roofing panel upon said rising foam adhesive upon said roof to be covered;

each said hardened foam roofing panel has a top surface, a bottom surface, and at least one indented periphery;

said top surface having an integral layer of fabric bonded to said hardened foam roofing panel;

mating said at least one first periphery of said first hardened foam roofing panel to a further hardened foam roofing panel upon said layer of rising foam adhesive applied to said predetermined surface of said roof, said further hardened foam roofing panel having at least one further indented periphery, said at least one first indented periphery of said first hardened foam roofing panel being larger than said at least one second indented periphery of said second hardened foam roofing panel, thereby preventing a tight fit between said at least one first indented periphery of said first hardened foam roofing panel and said at least one second indented periphery of said second hardened foam roofing panel; and, fitting said at least one first indented periphery and said at least one second indented periphery loosely together with a gap provided between said first hardened foam roofing panel and said at least one second hardened foam roofing panel, allowing said rising foam adhesive to rise within said gap therebetween.

8. The method of producing a seamless roofing system according to claim 7, wherein said at least one first indented periphery and said at least one further indented periphery are tongue and groove, respectively.

9. The method of producing a seamless roofing system according to claim 8, wherein said groove is about 22 mm wide and said tongue is about 19 mm wide.

10. The method of producing a seamless roofing system according to claim 7, wherein said at least one first indented periphery and said at least one further indented periphery together form a ship and lap joint, respectively.

11. The method of producing a seamless roofing system according to claim 7, wherein said at least one first indented periphery and said at least one further indented periphery each have a first and a second groove, respectively; and a tongue slideably mounted within said first and said second grooves.

12. The method of producing a seamless roofing system as in claim 7 wherein said fabric is a non-woven polyester fabric.

* * * * *